United States Patent [19]

Oakley

[11] Patent Number: 4,636,187

[45] Date of Patent: Jan. 13, 1987

[54] METHODS AND APPARATUS FOR ERECTING TRAY-TYPE CARTONS

[75] Inventor: John R. Oakley, Swindon, England

[73] Assignee: Metal Box, p.l.c., Reading, England

[21] Appl. No.: 725,642

[22] Filed: Apr. 22, 1985

[30] Foreign Application Priority Data

May 4, 1984 [GB] United Kingdom ..... 8411523

[51] Int. Cl.[4] ..... B31B 1/44; B31B 1/52

[52] U.S. Cl. ..... 493/134; 493/142; 493/174; 493/179

[58] Field of Search ..... 493/134, 167, 174, 179, 493/142, 143

[56] References Cited

U.S. PATENT DOCUMENTS

| | | | |
|---|---|---|---|
| 2,014,046 | 9/1935 | Joslin | 493/143 |
| 2,925,758 | 2/1960 | Beetz | 493/167 |
| 3,435,738 | 4/1969 | Berney | 493/179 |
| 3,618,481 | 11/1971 | Odenhagen | 493/167 |
| 4,233,798 | 11/1980 | Helding | 53/76 |
| 4,295,839 | 10/1981 | Baker et al. | 493/143 |
| 4,295,841 | 10/1981 | Ward, Jr. | 493/295 |
| 4,417,882 | 11/1983 | Wallin | 493/174 |

FOREIGN PATENT DOCUMENTS

| | | | |
|---|---|---|---|
| 79200679 | 1/1981 | European Pat. Off. . | |
| 8304000 | 11/1983 | PCT Int'l Appl. | 493/134 |

*Primary Examiner*—Francis S. Husar
*Assistant Examiner*—William E. Terrell
*Attorney, Agent, or Firm*—Diller, Ramik & Wight

[57] ABSTRACT

In the erection of rectangular tray-type cartons from blanks of foldable sheet material, corner tabs which are to be uppermost in the erected carton are first folded up from the plane of the blank, which is then passed through a die by a punch to form the side wall. On completion of the stroke of the punch, the pair of opposed elongate panels which carry the uppermost tabs are folded outwardly by folding bars carried by the punch. The partially erected carton is then transferred to a continuously moving conveyor and the other pair of elongate panels are folded outwardly by oscillating fingers and plough bars. The upstanding tabs are then heated by travelling hot air jets and pressed down by pressure rollers to seal them to the other tabs and complete the horizontal peripheral flange which extends continuously around the carton.

16 Claims, 7 Drawing Figures

METHODS AND APPARATUS FOR ERECTING TRAY-TYPE CARTONS

BACKGROUND OF THE INVENTION

1. Field of the Invention

This invention relates to methods and apparatus for erecting tray-type cartons, more particularly for erecting from a blank of foldable sheet material a rectangular tray-type carton of the kind having a base formed from a base panel of the blank, a side wall upstanding from the base and formed from four side wall panels, gusset folds secured against the side wall at the corners of the carton and formed from gusset panels by which the side wall panels are joined integrally together, and a continuous peripheral flange outturned from the side wall around the mouth of the carton, the flange being formed from elongate panels carried by the side wall panels and formed at their ends with tabs which are secured together in overlapping relation at the corners of the carton. A flat closure lid can be attached to the carton, for example by heat-sealing the margin of the lid to the upper surface of the peripheral flange.

2. Description of the Prior Art

In the erection of rectangular tray-type cartons having peripheral flanges from flat blanks, it is known to form the flanges by the same operation as is used to fold up the side wall panels of the cartons in relation to the carton bases. Such a method, however, has several disadvantages attendant upon the formation of the peripheral flanges. It is also known from our copending British Patent Application No. 8213491 (Publication No. 2120161), as a first step in the folding process, to fold up from the plane of the blank those of the tabs which are to be uppermost in the erected carton, so that they will not interfere with the other tabs but will be correctly positioned during the subsequent steps of the folding process. In the process described in our said application, the subsequent steps comprise: (a) at a first station, forming the side wall by folding up the side wall panels in relation to the base panel whilst folding the gusset panels to form the gusset folds, such folding being accompanied by movement of the elongate panels with the side wall panels as coplanar extensions thereof with the exception of the said uppermost ones of the tabs, (b) moving the partially erected carton from the first station to a second station, (c) at the second station, folding the elongate panels outwardly in relation to the side wall and into generally coplanar relation with one another, with the said uppermost tabs overlying other ones of the tabs at the corners of the carton, and (d) securing the overlapping tabs together at the corners of the carton to form a continuous peripheral flange.

In the preferred embodiment the folding is effected by a punch and die arrangement. This process has proved commercially successful but it does in practice require the use of a number of separate operating stations and an indexing conveyor to stop the movement of the cartons at the second station for folding of the two pairs of opposed elongate panels.

SUMMARY OF THE INVENTION

An object of the present invention is to provide a process and apparatus of a simplified nature which will operate with a continuously moving conveyor, avoiding the need for an indexing movement.

According to the present invention, a method of erecting a carton of the kind referred to above comprises the steps of:

(a) at an initial forming station incorporating a punch and die arrangement, folding up from th plane of the blank those of the tabs which are to be uppermost in the erected carton, then forcing the blank through the die by means of the punch so as to form the side wall by folding up the side wall panels in relation to the base panel whilst folding the gusset panels to form the gusset folds, the elongate panels moving with the side wall panels as coplanar extensions thereof with the exception of the said uppermost ones of the tabs, and then, on completion of the stroke of the punch, folding outwardly the pair of opposed elongate panels which carry the said uppermost ones of the tabs, (b) transferring the partially erected carton from the punch to a conveyor which moves continuously in a direction perpendicular to the length of the already folded pair of elongate panels and carrying the carton on said conveyor while folding the other pair of elongate panels outwardly in relation to the side wall and into generally coplanar relation with the first mentioned pair;

(c) directing hot gas at the surfaces of said tabs which are to be joined together so as to activate an adhesive provided thereon, and (d) securing the overlapping tabs together at the corners of the carton to form the continuous peripheral flange.

By thus performing the folding of the first pair of elongate panels at the initial forming station, it becomes possible in accordance with the process outlined above to perform the folding of the second pair and the other necessary operations while carrying the carton along the continuously moving conveyor.

At the initial forming station, the folding up of the tabs which are to be uppermost may be effected by means of pivotal fingers which are raised to fold the tabs upwards while the base of the blank is restrained by the punch against upward movement. The outward folding of the pair of opposed elongate panels which carry the uppermost tabs may be effected by a pair of folding bars pivotally mounted on the punch and actuated at the end of the movement of the punch through the die. The partially erected carton may be held on the punch by retractable holding bars while the elongate panels which carry the uppermost tabs are folded.

The outward folding of the other pair of elongate panels may be initiated by oscillating fingers actuated in timed relationship with the movement of the carton. The folding of this other pair of elongate panels may be completed by engagement with profiled bars disposed on each side of the conveyor.

The hot gas may be directed at the surfaces of the tabs by means of laterally directed jets of hot air which travel parallel to the conveyor and at the same speed.

The overlapping tabs may be secured together by pressure rollers.

The invention also resides in apparatus for erecting a blank of foldable sheet material into a rectangular tray-type carton of the kind described above, wherein the apparatus comprises:

(a) an initial forming station incorporating pivotal fingers arranged to be operated to fold up from the plane of the blank those of the tabs which are to be uppermost in the erected carton, a punch arranged to force the blank through a die to form the side wall by folding up the side wall panels in relation to the base panel whilst folding the gusset panels to form the gusset folds, the elongate panels moving with the side wall panels as coplanar extensions thereof with the exception of the said uppermost ones of the tabs, and folding means arranged to be operated on completion of the stroke of the punch to fold outwardly the pair of opposed panels which carry the said uppermost ones of the tabs, (b) a conveyor arranged to receive the partially erected carton from the first station and to transport it continuously through the remainder of the apparatus in a direction perpendicular to the length of the already folded pair of elongate panels, (c) folding means for folding the other pair of opposed elongate panels outwardly in relation to the side wall so as to form the peripheral flange, (d) means for directing hot gas at the surfaces of the tabs which are to be joined together for activating an adhesive provided thereon, and (e) sealing means for pressing the overlapping tabs together to bond them together and thus complete the peripheral flange.

The folding means arranged to be operated on completion of the stroke of the punch may comprise a pair of folding bars pivotally mounted on the punch and actuated by a rod which is axially movable within a punch operating rod on which the punch is fixed.

A pair of retractable holding bars may be mounted adjacent to the die for holding the partially erected carton on the punch at the end of the stroke of the punch. These holding bars may be mechanically linked to the pivotal fingers so as to retract the fingers for receipt of the next blank as the holding bars are retracted to release the preceding blank from the punch.

The folding means for folding the other pair of opposed elongate panels may comprise a pair of oscillating fingers mounted on respective shafts adjacent and parallel to each side of the conveyor and a linkage arranged to actuate the oscillating fingers to initiate the folding in timed relationship with the movement of the carton along the conveyor. These folding means may further comprise a pair of profiled bars disposed adjacent and parallel to each side of the conveyor downstream from the oscillating fingers.

The means for directing hot gas at the surfaces of the tabs may comprise devices arranged at each side of the conveyor and arranged to produce laterally directed jets of hot air which travel parallel to the conveyor and at the same speed.

The sealing means may comprise pressure rollers.

DETAILED DESCRIPTION OF THE INVENTION

Figure 1:
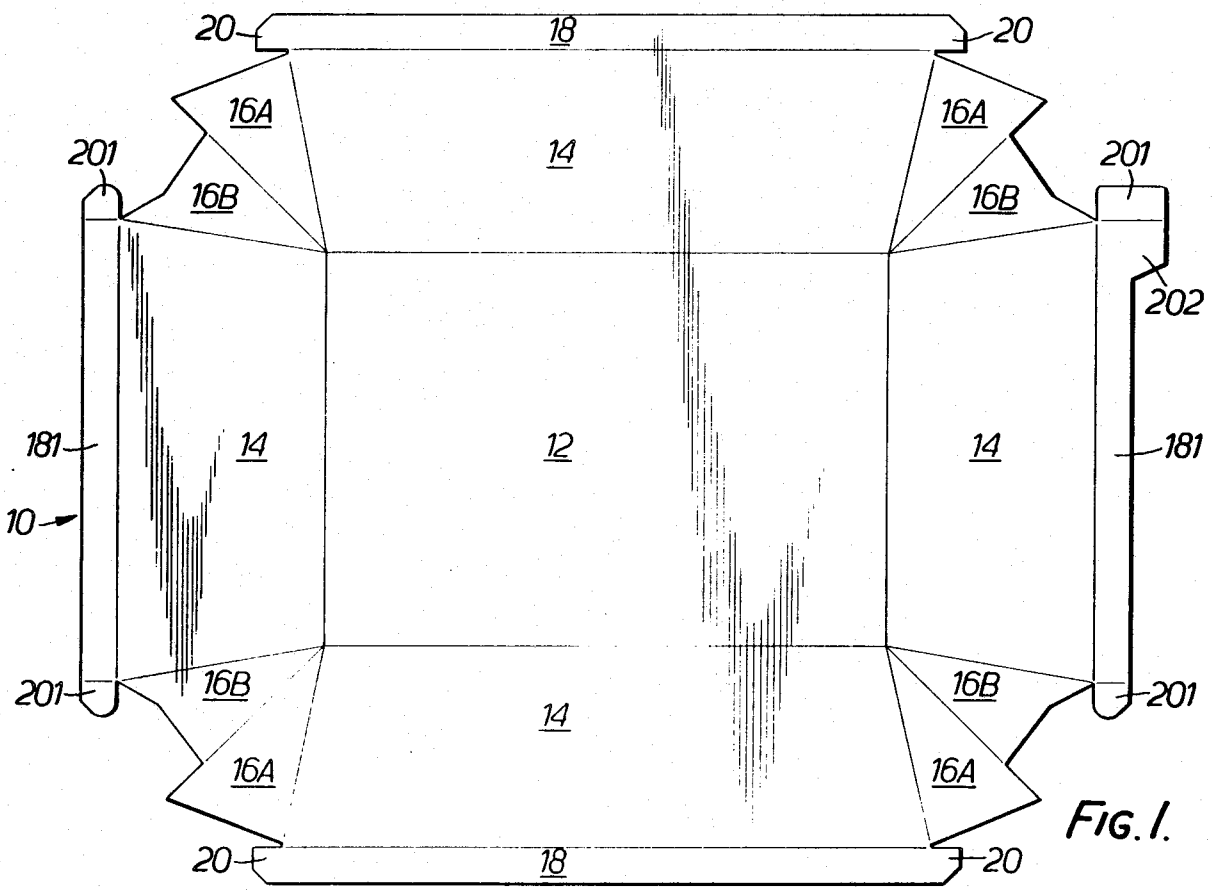
FIG. 1 is a plan view of a carton blank for erection to form a tray-type carton having a peripheral flange.

Referring now to FIG. 1, a blank 10 for forming a rectangular tray-type packaging container for a food product is cut and creased from cardboard which is provided on one surface, that is to say, the surface which is to form the interior of the carton, with an overall coating of a polyester resin such as polyethylene terephthalate. The coating, which is heat-resistant, is not shown in the drawing but will be understood to be located on the surface which is visible to the reader. In known manner it is heat-sealable to itself under conditions of heat and pressure.

The blank 10 is generally rectangular and is internally sub-divided by crease lines to form it with a rectangular base panel 12, four side wall panels 14 disposed at the four sides of the base panel, gusset panels 16A, 16B at the corners of the blank and joining adjacent side wall panels 14 integrally together, and elongate panels 18, 181 carried individually by the side wall panels around the periphery of the blank and having projecting tabs 20, 201 at their ends. One of the tabs 201 is enlarged in width and length as shown at 202. In the erected carton 110 (FIG. 2) the base panel 12 forms the carton base 22, the side wall panels 14 form the carton side wall 24, the gusset panels 16A, 16B are folded against one another to form gusset folds 26 which are disposed and secured against the side wall 24, and the elongate panels 18, 181 form an outturned, horizontal peripheral flange 28 which extends continuously around the carton, with a projecting tab 281. After the carton has been filled with product, the peripheral flange 28 provides a convenient surface on to which a closure lid having a projecting tab corresponding to tab 281 may be attached. The tabs facilitate removal of the lid by the purchaser when the container is to be opened.

It will be seen in FIGS. 1 and 2 that the side wall is made upwardly and outwardly tapering by suitable inclination of the crease lines defining the ends of its side wall panels 14, and the gusset folds 26 are secured against the side wall at tab portions 30 of the gusset panels 16A, which are brought into contact with the side wall when the gusset folds are formed and which are subsequently heat-sealed to the side wall. Furthermore, it should be noted that the tabs 20, 201 are overlapped in pairs at the corners of the carton and heat-sealed together to form the continuous peripheral flange 28, the uppermost ones 201 of the tabs being each provided by the elongate panels 181 of two opposed side wall panels 14. The significance of this will become apparent from the description which follows.

Figure 2:
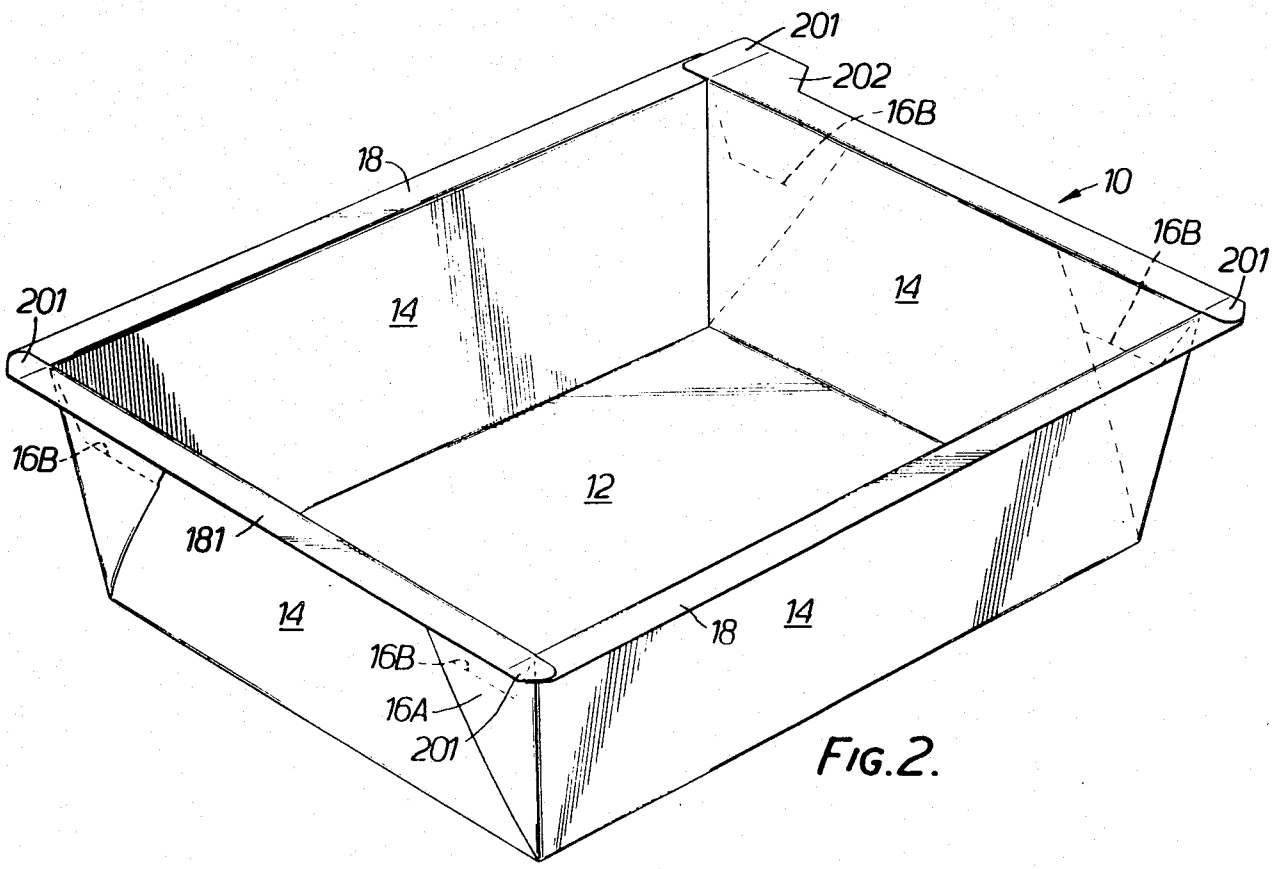
FIG. 2 is a perspective view of the carton erected from the blank of FIG. 1.
Figure 3:
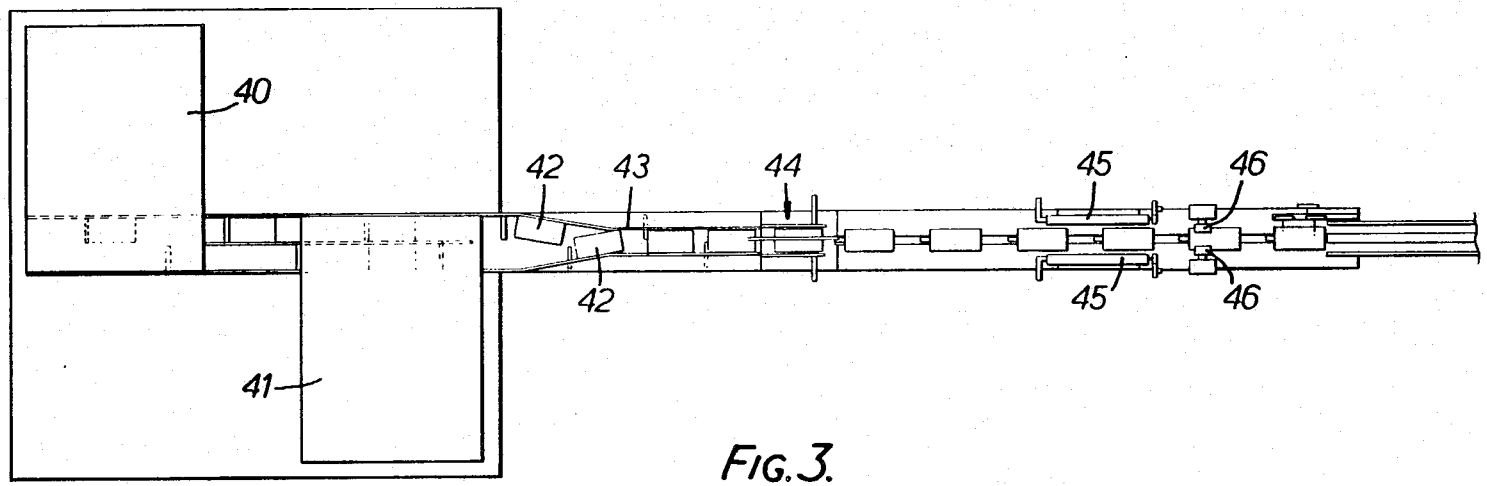
FIG. 3 is a diagrammatic plan view of apparatus for erecting cartons as shown in FIG. 2 from blanks as shown in FIG. 1.
Figure 4:
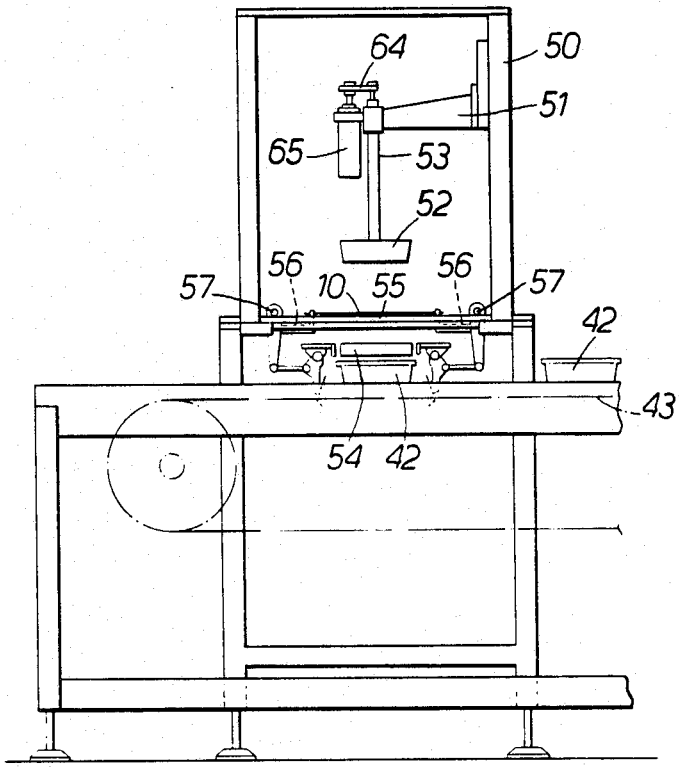
FIG. 4 is a diagrammatic elevation of an initial forming station forming part of the apparatus of FIG. 3.
Figure 5:
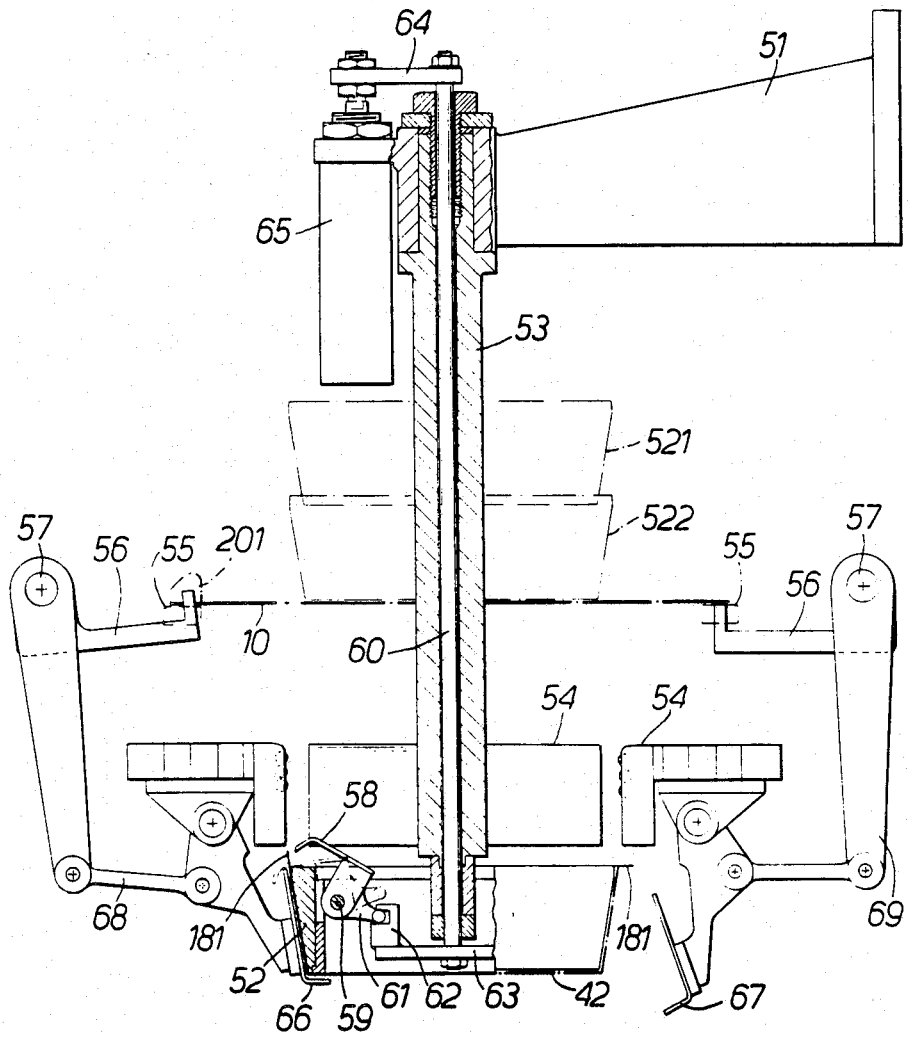
FIG. 5 is a part-sectional elevation, to a larger scale, of the essential working integers of the initial forming station.

Referring now to FIG. 3, the apparatus for erecting the blank 10 of FIG. 1 to form the tray-type carton 110 of FIG. 2 is diagrammatically shown to comprise two initial forming sections 40, 41 which are essentially identical and are illustrated in more detail in FIGS. 4 and 5. Partially erected cartons 42 pass from the stations 40, 41 via a conveyor 43 and their second or lateral pair of elongate panels 18 are folded outwardly as they pass folding means 44 indicated diagrammatically in FIG. 3 and illustrated in more detail in FIGS. 6 and 7. The cartons 42 are then carried past means 45 which direct lateral jets of hot air onto the surfaces of the upstanding tabs, which are then pressed flat on to the underlying tabs by pressure rollers 46. The tray-type cartons are then complete and can be stacked ready for filling.

As shown in FIGS. 4 and 5, each initial forming station 40, 41 comprises a frame 50 in which a punch support 51 is vertically movable. The punch 52 is fixed to the lower end of a punch operating rod 53 whose upper end is carried by the punch support 51. A die 54 is supported in the lower part of the frame 50. Blanks 10 are fed to support bars 55 in a direction at right angles to the plane of the paper in FIG. 4. Pivotal fingers 56, more clearly seen in FIG. 5, are mounted on shafts 57 supported on the frame 50.

A pair of folding bars 58, of which only one is shown in FIG. 5, are pivotally mounted in the punch 52. The folding bars 58 can be pivoted about their pivots 59 by means of a rod 60 axially movable within the punch operating rod 53, through an extension 61 on the folding bar 58 engaging in a recess in a lug 62 mounted on a bar 63 carried by the lower end of the rod 60. The upper end of the rod 60 is connected by a cross-bar 64 to the vertically movable piston of a pneumatic cylinder 65. Raising the rod 60 by means of the pneumatic cylinder 65 causes the folding bar 58 to move from the position shown in full lines in FIG. 5 to that shown in chain lines.

A pair of retractable holding bars 66, 67 are pivotally mounted adjacent the die 54 and connected by linkages 68, 69 to the pivotal fingers 56. In FIG. 5, holding bar 66 is shown in the operative position adjacent to the punch 52 at the lower end of its stroke while holding bar 67 is shown in its retracted position. It will be seen that when the holding bars are in their retracted position the pivotal fingers 56 are also in their retracted position ready to receive a blank.

In use, when a blank 10 has been fed into position as shown in chain lines in FIG. 5, the punch 52 is lowered from its upper position shown at 521 to the position shown at 522 where it contacts the upper surface of the blank. The shafts 57 are then rotated to raise the fingers 56 against the tabs 201 (FIGS. 1 and 2) and to fold them up from the plane of the blank. The tabs 201 are of course those which are to be uppermost in the erected carton. At the same time, the rotation of the shafts 57 moves the holding bars 66, 67 into their operative position as shown at the left-hand side of FIG. 5.

The punch 52 then continues its downward stroke and forces the blank 10 through the die 54, thereby forming the side wall 24 of the carton by folding up the side wall panels 14 in relation to the base panel 12, while the gusset panels 16A, 16B are folded against one another to form gusset folds 26 which are disposed and secured against the side wall 24. At this stage, the elongate panels 18, 181 remain as coplanar extensions of their respective side wall panels with the exception of the tabs 201.

On completion of the stroke of the punch 52 to the position shown in full lines in FIG. 5, the partially erected carton is received within the holding bars 66, 67. The pneumatic cylinder 65 is operated to pivot the folding bars 58 to the position shown in chain lines in FIG. 5 so as to fold the elongate panels 181 outwardly. The folding bars 58 fold the panels 181 sufficiently far beyond the horizontal that on springing back they will adopt an approximately horizontal position as shown on the right-hand side of FIG. 5.

Figure 6:
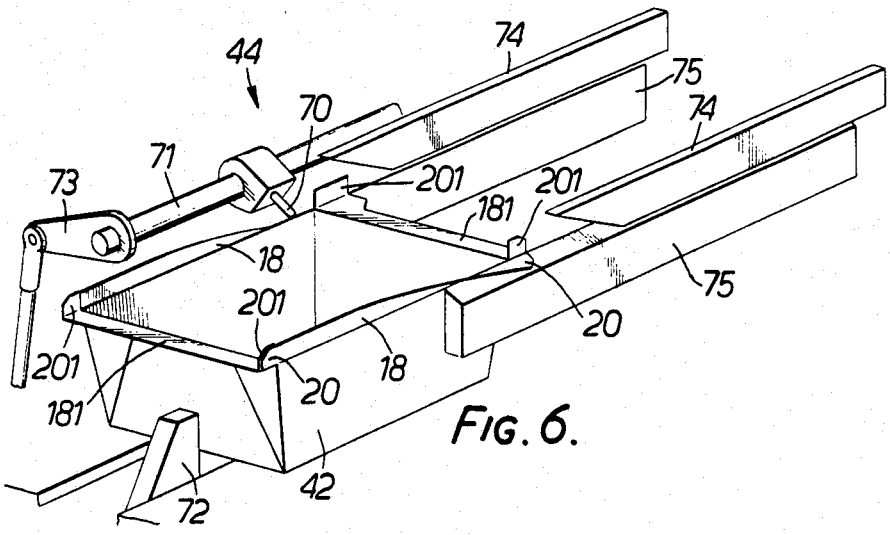
FIG. 6 is a perspective view of a carton being carried from the initial forming station and having its second pair of flanges folded.
Figure 7:
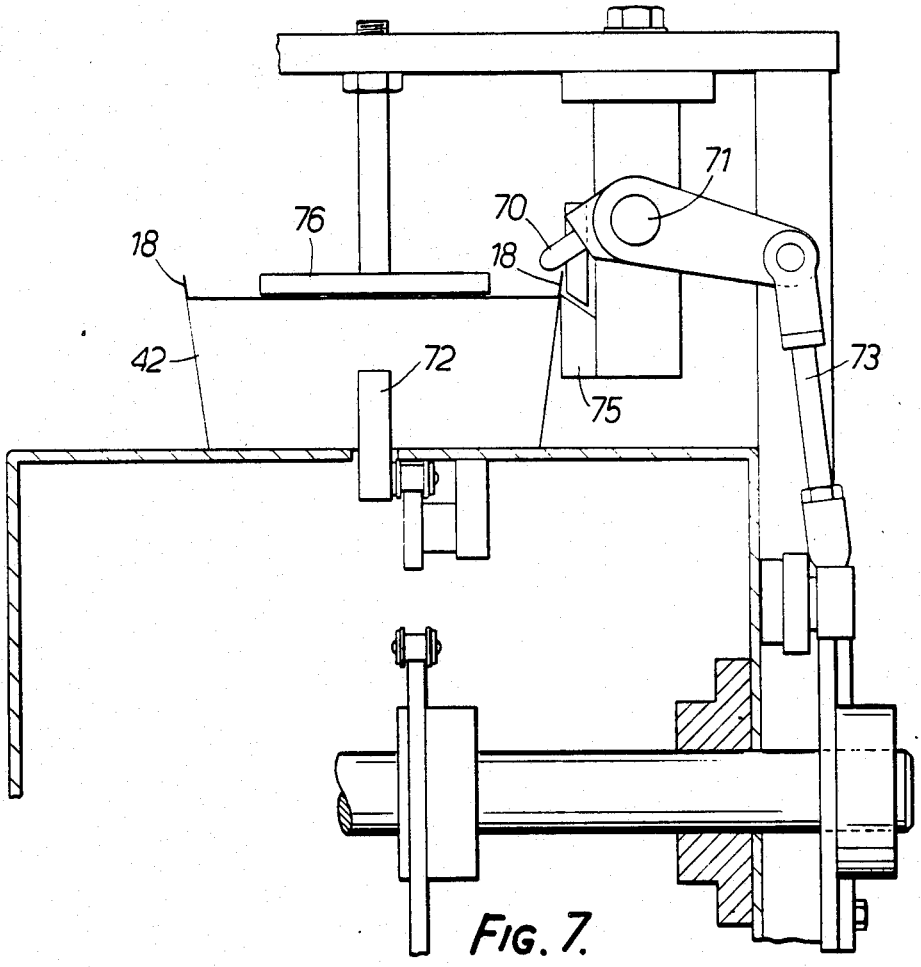
FIG. 7 is a diagrammatic end elevation of the conveyor and folding mechanism shown in FIG. 6.

The holding bars 66, 67 are now retracted to release the partially erected carton 42 and to allow it to fall onto the conveyor 43 for onward transmission to the folding means 44 shown in more detail in FIGS. 6 and 7, while the punch 52 is retracted to position 521.

As shown in FIGS. 6 and 7, the folding means for folding the other pair of opposed elongated panels 18 comprise firstly a pair of oscillating fingers 70 (of which only one is shown in FIG. 6 and the other in FIG. 7) mounted on respective shafts 71 adjacent and parallel to each side of the conveyor 43 which propels the cartons 42 by means of dogs 72. The shafts 71 are connected by a linkage 73 to the conveyor driving mechanism so as to rotate the oscillating fingers 70 about the axes of shafts 71 from the inoperative position shown in FIG. 7 to the operative position of FIG. 6, to initiate folding of the panels 18 in timed relationship with the movement of the carton 42, as the conveyor 43 moves it into the position shown in FIG. 6.

The folding means 44 further comprises a pair of profiled bars or ploughs 74 disposed one on each side of the conveyor 43 and parallel to it, downstream from the oscillating fingers 70. The profiled bars 74 each cooperate with a similarly profiled lower anvil bar 75 to receive the elongate panel 18 and fold it downwardly to such an extent that, on springing back, it will assume a substantially horizontal position. In order to stabilise the carton 42 during the folding operation, a static horizontal hold-down bar 76 is provided as shown in FIG. 7.

On leaving the folding means 44, the peripheral flange 28 is complete except that the tabs 201 are still upstanding as in FIG. 6. The carton is now traversed past devices 45 (FIG. 3) arranged at each side of the conveyor for producing laterally directed jets of hot air which impinge on the tabs 201 and travel parallel to the conveyor and at the same speed, so as to activate the heat-sealable coating on the surface of the tabs. Devices suitable for producing such travelling jets of hot air are described and claimed in our co-pending British Patent Application No. 8411522.

Finally the carton 42 is carried past pressure rollers 46 which co-act with support bars (not shown) to press the tabs 201 into contact with the tabs 20 and seal them together.

The method and apparatus described provide a relatively simple and highly efficient means of erecting tray-type cartons from blanks as shown in FIG. 1, avoiding the need for indexing motion of the conveyor.

I claim:

1. A method of erecting from a blank of foldable sheet material a rectangular tray-type carton having a base formed from a base panel of the blank, a side wall upstanding from the base and formed from four side wall panels, gusset folds secured against the side wall at the corners of the carton and formed form gusset panels by which the side wall panels are joined integrally together, and a continuous peripheral flange outturned form the side wall around the mouth of the carton, the flange being formed from elongate panels carried by the side wall panels and formed at their ends with tabs having surfaces which are secured together in overlapping relation at the corners of the carton by heat-sealing, characterised by the steps of:

(a) at an initial forming station incorporating a punch and die arrangement, partially erecting the carton by (i) folding up from the plane of the blank those of the tabs which are to be uppermost in the erected carton, (ii) then forcing the blank through the die by stroking the punch, thereby forming the side wall by folding up the side wall panels in relation to the base panel and folding the gusset panels to form the gusset folds, the elongate panels moving with the side wall panels as coplanar extensions thereof with the exception of the said uppermost ones of the tabs, and (iii) then, on completion of the stroke of the punch, folding outwardly the pair of opposed elongate panels which carry the said uppermost ones of the tabs, thereby moving the said uppermost tabs to upstanding positions in which their surfaces which are to be secured to the surfaces of the others of said tabs face laterally outwardly, (b) transferring the partially erected carton from the punch to a conveyor which moves continuously in a direction perpendicular to the length of the already folded pair of elongate panels and carrying the carton on said conveyor, (c) while carrying said carton on said conveyor, folding the other pair of elongate panels including the said other tabs outwardly in relation to the side wall and into generally coplanar relation with the first mentioned pair, (d) while continuing to carry said carton on said conveyor, directing hot gas at the said laterally outwardly facing surfaces of said uppermost tabs thereby activating an adhesive provided thereon, and (e) while further continuing to carry said carton on said conveyor, pressing said uppermost tabs into contact with said other tabs in overlapping relationship and thereby securing the overlapping tabs together at the corners of the carton to form the continuous peripheral flange.

2. A method according to claim 1 comprising, in step (a) (i), restraining the base of the blank against upward movement by means of said punch while engaging the tabs which are to be uppermost by pivotal fingers and lifting said fingers to fold the tabs upwardly.

3. A method according to claim 1 comprising, in step (a)(iii), actuating a pair of folding bars pivotally mounted on the punch when said punch completes its movement through the die, whereby to effect said outward folding of the pair of opposed elongate panels which carry the said uppermost ones of the tabs.

4. A method according to claim 3 comprising holding the partially erected carton on the punch by retractable holding bars while the elongate panel which carry the uppermost tabs are folded.

5. A method according to claim 1 wherein the outward folding of the other pair of elongate panels is initiated by oscillating fingers actuated in timed relationship with the movement of the carton.

6. A method according to claim 5 comprising completing the folding of the other pair of elongate panels by engagement with profiled bars disposed on each side of the conveyor.

7. A method according to claim 1 comprising directing the hot gas at the surfaces of the tabs in step (d) by means of laterally directed jets of hot air which travel parallel to the conveyor and at the same speed.

8. A method according to claim 1 comprising pressing said overlapping tabs into contact in step (e) by pressure rollers.

9. Apparatus for erecting a blank of foldable sheet material into a rectangular tray-type carton having a base formed from a base panel of the blank, a side wall upstanding from the base and formed from four side wall panels, gusset folds secured against the side wall at the corner of the carton and formed from gusset panels by which the side wall panels are joined integrally together, and a continuous peripheral flange outturned from the side wall around the mouth of the carton, the flange being formed from elongate panels carried by the side wall panels and formed at their ends with tabs having surfaces which are secured together in overlapping relation at the corners of the carton by heat-sealing, characterised in that the apparatus comprises:

(a) an intial forming station incorporating means for supporting a blank in a substantially horizontal plane, a punch movable vertically through the plane of the blank, a die disposed below the plane of the blank for cooperating with said punch to fold up said side wall, pivotal fingers arranged adjacent to the plane of the blank, means associated with said pivotal fingers for operating said pivotal fingers prior to folding up said side wall so as to fold up from the plane of the blank those of the tabs which are to be uppermost in the erected carton, the punch being arranged to force the blank in a stroke through the die to form the side wall by folding up the side wall panels in relation to the base panel whilst folding the gusset panels to form the gusset folds, the elongate panels moving with the side wall panels as coplanar extensions thereof with the exception of the said uppermost ones of the tabs, and folding means arranged to be operated on completion of the stroke of the punch to fold outwardly the pair of opposed panels which carry the said uppermost ones of the tabs, whereby said uppermost tabs are disposed with their surfaces which are to be secured to the surfaces of the others of said tabs facing laterally outwardly, (b) a conveyor arranged to receive the partially erected carton from the initial forming station and to transport it continuously through the remainder of the apparatus in a direction perpendicular to the length of the already folded pair of elongate panels, (c) folding means disposed adjacent to said conveyor downstream from said initial forming station for folding the other pair of opposed elongate panels outwardly in relation to the side wall so as to form the peripheral flange, (d) means disposed on both sides of said conveyor for directing hot gas at the said laterally outwardly facing surfaces of said uppermost tabs for activating an adhesive provided thereon, and (e) sealing means disposed adjacent to said conveyor downstream from said hot gas directing means for pressing said uppermost tabs into contact with said other tabs in overlapping relationship to bond them together and thus complete the peripheral flange.

10. Apparatus according to claim 9 wherein the folding means arranged to be operated on completion of the stroke of the punch comprise a pair of folding bars pivotally mounted on the punch and actuated by a rod which is axially movable within a punch operating rod on which the punch is fixed.

11. Apparatus according to claim 9 wherein a pair of retractable holding bars are mounted adjacent to the die for holding the partially erected carton on the punch at the end of the stroke of the punch.

12. Apparatus according to claim 11 wherein the retractable holding bars are mechanically linked to the pivotal fingers so as to retract the fingers for receipt of the next blank as the holding bars are retracted to release the preceding blank from the punch.

13. Apparatus according to claim 9 wherein the folding means for folding the other pair of opposed elongate panels comprise a pair of oscillating fingers mounted on respective shafts adjacent and parallel to each side of the conveyor and a linkage arranged to actuate the oscillating fingers to initiate the folding in timed relationship with the movement of the carton along the conveyor.

14. Apparatus according to claim 13 wherein the folding means for folding the other pair of elongate panels further comprise a pair of profiled bars disposed adjacent and parallel to each side of the conveyor downstream from the oscillating fingers.

15. Apparatus according to claim 9 wherein the means for directing hot gas at the surfaces of the tabs comprise devices arranged at each side of the conveyor and arranged to produce laterally directed jets of hot air which travel parallel to the conveyor and at the same speed.

16. Apparatus according to claim 9 wherein the sealing means comprise pressure rollers.

* * * * *